US005219384A

United States Patent [19]

Elsfelder et al.

[11] Patent Number: 5,219,384

[45] Date of Patent: Jun. 15, 1993

[54] VEHICLE LOCK PROTECTOR

[76] Inventors: Mark S. Elsfelder, 223 So. Tekoppel Ave., Evansville, Ind. 47712; Daniel A. Vanbibber, 2812 So. Ruston Ave., Evansville, Ind. 47715

[21] Appl. No.: 812,043

[22] Filed: Dec. 23, 1991

[51] Int. Cl.[5] ..... E05B 67/38

[52] U.S. Cl. ..... 70/18; 70/54; 70/56; 70/417; 70/233

[58] Field of Search ..... 70/14, 18, 19, 31, 49, 70/52-56, 416, 417, 233

[56] References Cited

U.S. PATENT DOCUMENTS

| | | | |
|---|---|---|---|
| 3,751,948 | 8/1973 | Klein | 70/55 |
| 3,756,008 | 9/1973 | Smith | 70/18 X |
| 3,800,570 | 4/1974 | Kaplan | 70/18 |
| 3,808,847 | 5/1974 | Vesely | 70/56 X |
| 3,886,770 | 6/1975 | Smith | 70/18 |
| 4,106,315 | 8/1978 | Dohanyos | 70/417 X |
| 4,112,716 | 9/1978 | Wippich | 70/52 X |
| 4,760,720 | 8/1988 | Grille | 70/56 X |
| 4,781,043 | 11/1988 | Loeffler | 70/54 |
| 4,877,275 | 10/1989 | DeForrest, Sr. | 70/56 X |
| 4,896,518 | 1/1990 | Appelgren | 70/56 X |
| 4,898,008 | 2/1990 | Eberly | 70/56 |
| 5,065,603 | 11/1991 | Kloke | 70/233 |

FOREIGN PATENT DOCUMENTS

| | | | |
|---|---|---|---|
| 2185519 | 7/1987 | United Kingdom | 70/54 |

*Primary Examiner*—Peter M. Cuomo
*Assistant Examiner*—Suzanne L. Dino
*Attorney, Agent, or Firm*—Polster, Lieder, Woodruff & Lucchesi

[57] ABSTRACT

A protector for a lock used in combination with a steel cable to prevent theft of a two-wheeled vehicle. The lock is received within the protector and when at a locked condition, the shackle portion thereof is inaccessible, as to a bolt cutter, and where the steel cable is incapable of being severed by a bolt cutter.

5 Claims, 1 Drawing Sheet

FIG. 1
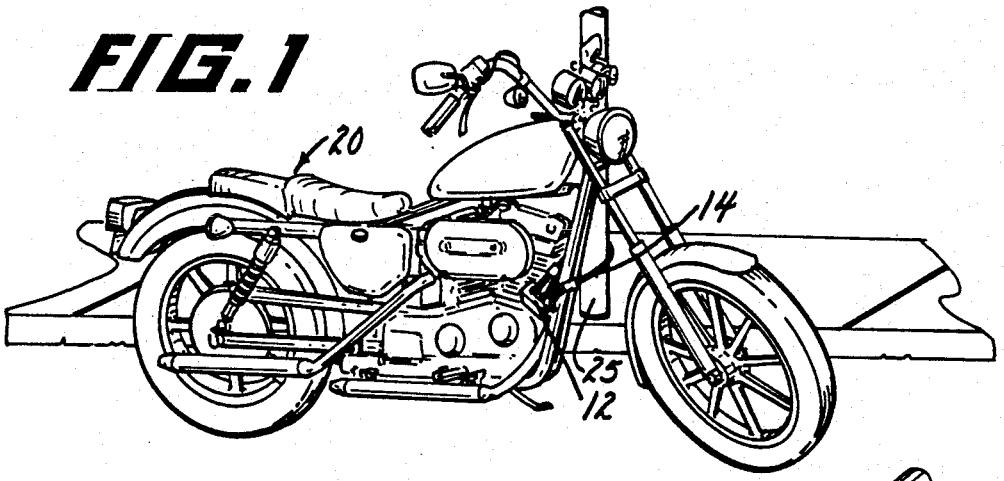
FIG. 2
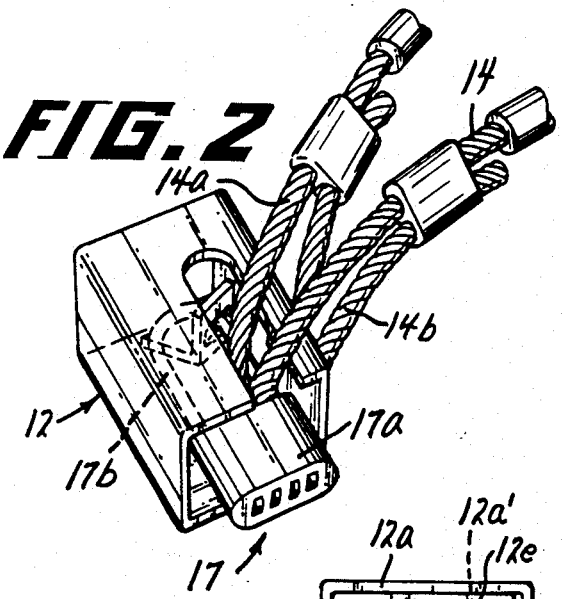
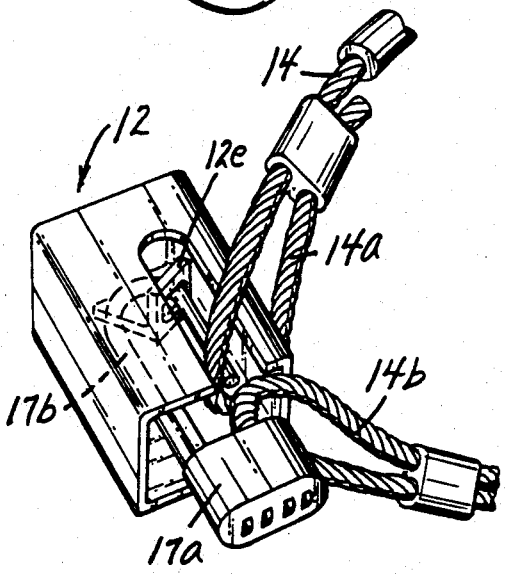
FIG. 3
FIG. 5
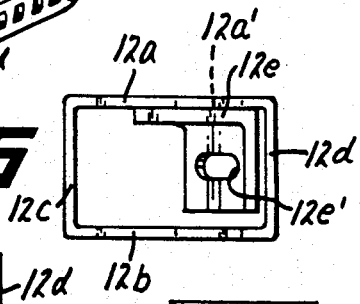
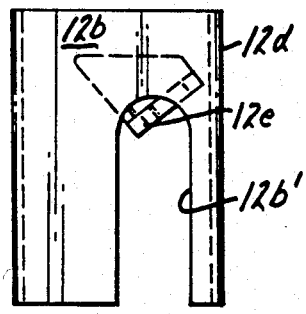
FIG. 4
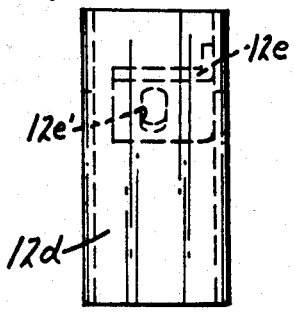
FIG. 6
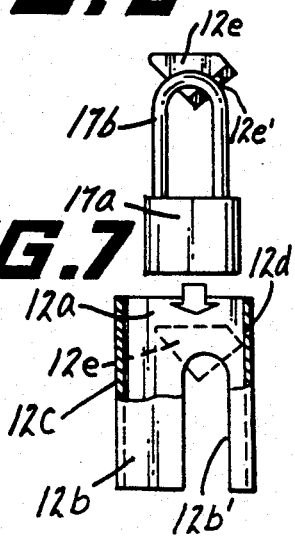
FIG. 7

VEHICLE LOCK PROTECTOR

BACKGROUND OF THE INVENTION

As is known, the use of two-wheeled vehicles, such as motorcycles, bicycles and the like, is widespread and ever increasing. An inherent difficulty with use and/or ownership is in connection with possible theft, particularly since a considerable money expenditure is usually involved for purchase. Many anti-theft arrangements have been considered, but, oftentimes, such are not formidable against bolt cutter action, i.e. a common bolt cutter readily frees the vehicle even when the latter is at a chain locked position, either by cutting the chain and/or the lock or both.

DESCRIPTION OF THE INVENTION

The invention overcomes the preceding problem by providing a sheet metal protector which receives and/or overlies either the lock, which may be fixed or removable, and the looped ends of a steel cable retained within the protector.

When the lock is at a locked position, such is mostly surrounded by the protector, preventing access to the shackle of the lock by a bolt cutter and, as well, the cutting of the steel cable by the latter.

Ordinarily, the steel cable extends between the frame portion of the two-wheeled vehicle and a fixed and/or stationary member, such as a post. Thus, and as stated, the would-be theft is defeated by lack of access to the lock, in view of the protector, and the inability to cut through the steel cable.

DESCRIPTION OF THE FIGURES

In any event, a better understanding of the present invention will become more apparent from the following description, taken in conjunction with the accompanying drawing, wherein FIG. 1 is a view in side elevation showing the vehicle lock protector of the invention in a use condition;

FIG. 2 is a perspective view showing the instant protector at a position after locking;

FIG. 3 is another perspective view of the instant protector, but showing the protector at a position prior to locking;

FIG. 4 is a view in side elevation detailing one side of the instant protector;

FIG. 5 is a top plan view, looking downwardly on FIG. 4, further detailing the invention;

FIG. 6 is another view in side elevation, looking from right to left in FIG. 4, still further detailing the protector; and, FIG. 7 is a view in side elevation, comparing with FIG. 4, but detailing the assembly of the lock within the protector.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Referring now to the figures, the lock protector 12 of the invention is disclosed, in FIG. 1, at an installation site, as where a motorcycle 20 is secured to a fixed or stationary post 25. A steel cable 14 is provided and includes secured looped ends 14*a*,14*b* (see FIGS. 2 and 3). The average locking arrangement preferably interconnects the frame of the motorcycle 20 with the stationary post 25, instead of, for example, with a wheel (which could be removed).

The instant protector 12 is fabricated from sheet metal and includes blending side walls 12*a*,12*b*,12*c* and 12*d* and open ends. Walls 12*a*,12*b* have correspondingly positioned elongated slots 12*a*',12*b*' therein. The protector 12 is readily handheld.

Disposed within protector 12 is an angling member 12*e* presenting an opening 12*e*', the latter having various length dimensions to accommodate the type of lock 17 employed, where the latter may be fixed or removable. In other words, and as particularly evident in FIG. 7, a typical lock 17 includes a case or body 17*a* for the locking mechanism and a shackle 17*b*, U-shaped, movable to a spaced-apart condition, i.e. with respect to the case 17*a*, so as to receive the looped cable ends 14*a*,14*b*.

In other words, when the lock 17 and steel cable 14 are in a secured position (see FIG. 2), no access is achievable either to the shackle 17*b* of the lock 17 or to the concealed (within the protector 12) looped end portions 14*a*,14*b* of the cable 14, since only the case 17*a* extends from the protector 12.

On the other hand, when unlocked, and as stated, space is provided for passage of the looped cable ends 14*a*,14*b* (see FIG. 3), where the latter extend outwardly from the elongated slots 12*a*',12*b*'.

In any event, it should be evident that theft protection is effectively provided through the combined use of the instant lock protector and the use of steel cable. A bolt cutter cannot reach the shackle 17*b* of the lock 17 nor can the steel cable 14 be cut. Thus, multi-advantages are afforded by the invention.

The lock protector described above is susceptible to various changes within the spirit of the invention, including, by way of example, in proportioning; the precise location of the slots; the size of the opening in the angled inner member to satisfy lock size demands; and, the like. Thus, the preceding should be considered illustrative and not as limiting the scope of the following claims:

We claim:

1. A lock protector comprising a hollow body portion having walls, first and second open ends, elongated longitudinal slots facing each other in opposing side walls, and an angling member disposed proximate said first open end of said hollow body member and including an opening, said angling member extending inwardly in the direction of said second open end of said hollow body member, a lock including a shackle and a locking mechanism case, said lock extending within said hollow body member in a longitudinal direction, where said shackle of said lock extends through said opening in said angling member, and a steel cable having loops at opposite ends thereof, where said loops extend between said elongated longitudinal slots and through said shackle, and where said shackle is inaccessible when said lock is at a locked position, said locking mechanism case serving a blocking relationship with respect to said second open end of said hollow body member.

2. The lock of claim 1 where said steel cable and said lock interconnect the framework of a two-wheeled vehicle and a stationary member.

3. The lock of claim 1 where said lock is removable from said protector.

4. The lock of claim 1 where said lock is fixed within said protector.

5. The lock of claim 1 where said locking mechanism case is partially overlaid by said side walls of said protector at a use condition.

* * * * *